United States Patent [19]

Horowitz et al.

[11] 4,106,955

[45] Aug. 15, 1978

[54] COATING STEEL SURFACES

[75] Inventors: Carl Horowitz, Brooklyn; Duryodham Mangaraj, Staten Island; Joseph A. Iorio, Ozone Park, all of N.Y.

[73] Assignee: Gulf & Western Manufacturing Company, New York, N.Y.

[21] Appl. No.: 547,427

[22] Filed: Feb. 5, 1975

[51] Int. Cl.[2] ..... B05D 7/14; B05D 3/02

[52] U.S. Cl. ..... 148/6; 148/6.14 R; 427/386; 427/388 A

[58] Field of Search ..... 148/6, 6.14 R; 427/388 A, 386, 399

[56] References Cited

U.S. PATENT DOCUMENTS

| | | | |
|---|---|---|---|
| 2,776,918 | 1/1957 | Bersworth | 148/6.14 R |
| 3,401,049 | 9/1968 | Horowitz | 427/399 |
| 3,698,931 | 10/1972 | Horowitz | 427/399 |
| 3,865,617 | 2/1975 | Shimizu | 148/6.14 R |
| 3,924,021 | 12/1975 | Maruyama | 427/386 |
| 3,950,571 | 4/1976 | McBride | 427/386 |

OTHER PUBLICATIONS

Encyclopedia of Polymer Science & Technology, vol. 6, pp. 238, 239.

*Primary Examiner*—James R. Hoffman
*Attorney, Agent, or Firm*—William Anthony Drucker

[57] ABSTRACT

The invention relates to the coating of steel articles with organic polymeric material for the prevention of wear and corrosion. To obtain secure and permanent adhesion of the coating on the steel article the coating material is compounded so as to result in graft polymerization with the underlying steel face. Fillers may be included in the coating material for enhancing physical characteristics of strength, wear resistance etc., and a preferred coating material includes monomer having functional groups to interact both with the steel substrate and with the fillers. The coating material may be compounded so as to have flow characteristics, before curing, which permit a smooth and finished exposed face to be obtained, particularly on a rough or unfinished steel substrate surface. The coating process is particularly advantageous in the field of steel automative parts exposed to corrosive environments, for example ball studs.

5 Claims, 4 Drawing Figures

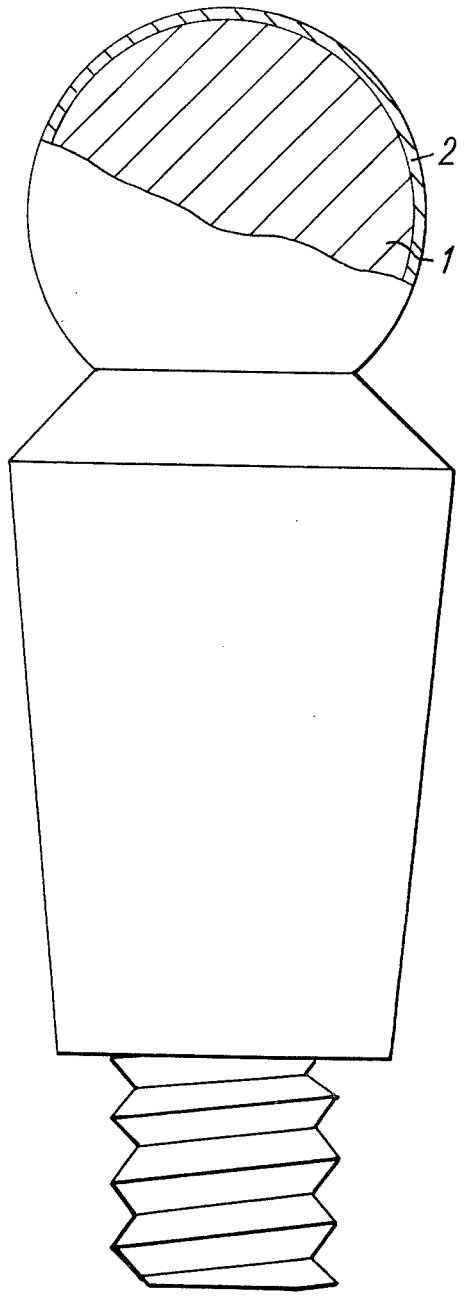
FIG. 1
FIG. 2
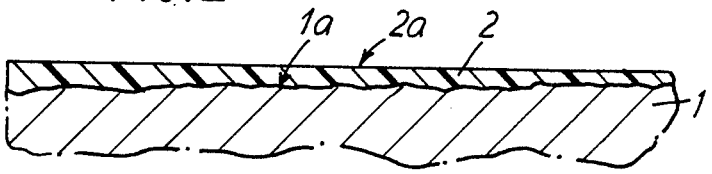

COATING STEEL SURFACES

BACKGROUND OF THE INVENTION

The field of art to which the invention appertains is the prevention of wear and corrosion of steel surfaces.

Articles of steel, unless specially compounded to be non-corroding or protected physically by external means, tend to corrode upon exposure to atmospheric conditions, and especially so under the combined action of atmospheric oxygen, moisture, and other chemical reagents present in the environment. By way of illustration, but without any limitation of the invention thereto, there may be mentioned automobile parts which are exposed to atmospheric conditions and water, salt, road debris, rock dust and the like, as a result of which they readily become corroded and may thereby become so reduced and weakened in strength as to be incapable of standing up to required dynamic stresses. The useful life of the automobile parts is thus reduced, and the weakening may give rise to dangers of breakage.

In order to overcome this disadvantage it has already been proposed to provide, on steel articles, a corrosion resistant coating of organic material, but hitherto it has not been possible to ensure that the organic coating will remain in position for an adequate length of time, and the coatings tend to separate from the steel article under the effects of the corroding atmosphere and the dynamic stresses present. Furthermore, the organic coatings suggested to date have not had anything like the wear resistance and mechanical strength of the underlying steel surface. Additionally, it was necessary to carry out expensive metal finishing processes on the coated article to make it frictionless and assure a long working life.

SUMMARY OF THE INVENTION

The present invention is based on the graft coating of otherwise unfinished steel articles with organic polymeric materials which become bonded to the steel. These polymeric materials may be selected and treated and mixed with additives so as to have improved wear resistance and frictional characteristics.

It is accordingly a primary object of the invention to provide a process for the graft coating of steel surfaces with organic polymeric material.

Another object of the invention is to provide organic polymeric coating materials of desired characteristics for application by graft coating so as to become bonded to steel workpieces.

Yet another object of the invention is to provide steel workpieces, and especially automobile parts, having a coating of organic polymeric material bonded permanently to the steel of the workpiece and adapted to resist corrosion and to have desirable wear resistance and frictional characteristics.

A still further object of the invention is to provide steel workpieces, and especially automobile parts such as ball studs, in which the exposed surface of the workpiece is produced in a relatively rough state, or is machined to less than normal fine finish, and has applied thereto a coating of organic polymeric material bonded substantially permanently to the steel of the workpiece, said coating itself having as a result of its inherent flow characteristics before curing, an exposed surface of smoothness and finish comparable to that which would otherwise need to be formed on the steel of the workpiece by additional fine finishing operations.

BRIEF DESCRIPTION OF THE DRAWINGS

In the accompanying drawings:

FIG. 1 is a side elevation, partly in section, of a steel ball stud as used in steering linkage of an automobile, treated in accordance with the invention;

FIG. 2 is a section, to a very much enlarged scale, of part of the steel surface of the ball stud showing a smooth organic polymeric coating bonded thereon;

DESCRIPTION OF THE PREFERRED EMBODIMENT

Figure 3:
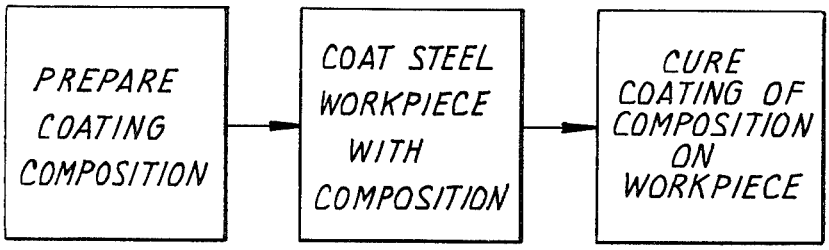
FIGS. 3 and 4 are flow diagrams, of two embodiments of process for applying organic polymeric coating material to a steel workpiece.
Figure 4:
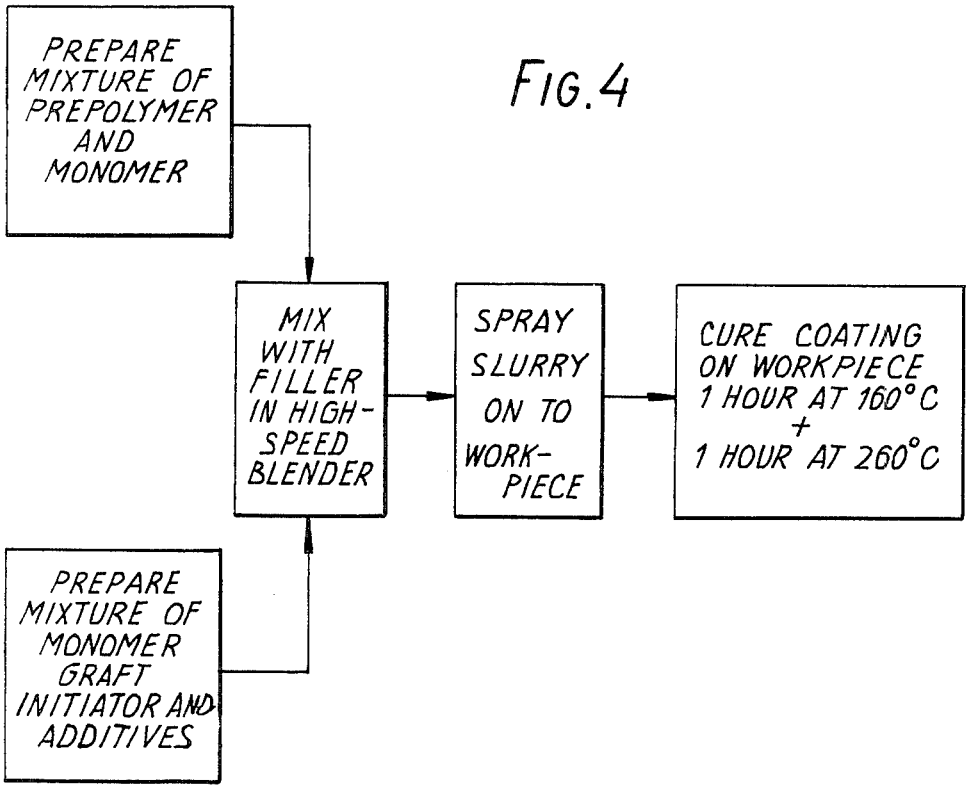

Many automobile and machine parts operate under dynamic stress and corrosive conditions. For example, ball studs forming part of the steering linkage of an automobile are subjected to a variety of unsymmetrical dynamic stresses, in an environment of heat, water and soil. The ball stud illustrated in the drawings has a body 1 which is prepared by conventional operations of casting and turning. Onto all or part of the body 1 there is applied a coating 2 of organic polymeric material which becomes graft bonded to the underlying steel face. By use of the process of the invention the components of the coating chemically interact with the surface of the steel and are then strongly bound to the steel, such that it can then stand up to the simultaneous effects of corrosive atmosphere and non-harmonic dynamic stress.

Further, the abrasion resistance of the organic polymeric coating may be increased by incorporating inorganic fillers, e.g.

tungsten carbide
silicon carbide
boron nitride
titanium dioxide

In a preferred form of the process of the present invention this is achieved by the process of molecular grafting such that monomers containing appropriate functional groups interact on the one hand with the steel substrate, and on the other hand with the mineral fillers, by simultaneously polymerizing in situ, thus providing a coating wherein the components are bound amongst themselves and to the substrate as well. Thus, for example, there is applied to the body 1 of the illustrated ball stud a system containing monomers, catalyst, prepolymer and inorganic fillers resulting in a coating which gives long life under severely corrosive atmosphere and non-harmonic stress.

According to a further feature of the invention, the coating 2 may provide, for the body 1 of the ball stud, an exposed face which is level and finished, without requiring levelling and finishing of the face of the steel workpiece by conventional operations. Referring to FIG. 2 of the drawings, the body 1 of the ball stud has a relatively non-level and non-finished exposed surface 1*a* to which the coating 2 is applied and bonded. The exposed face 2*a* of the coating is level and finely finished. The flow character of the coating material is adjusted such that during application, e.g. as by spraying, brush painting or dipping, the coating material will automatically assume the smooth exposed face condition 2*a* seen in FIG. 2, whereby the conventional expensive finishing operations otherwise required for such workpieces are eliminated.

Monomers containing active hydroxyl, carbonyl, amine, amide, glycidyl and aziridinyl groups and their analogues have been found most suitable for the purposes of the invention. Although the mechanism of interaction between the monomer and the steel has not been firmly established, the following mechanism is suggested: under the usual conditions of exposure to the atmosphere, steel develops oxide rust. Whereas most of the rust can be removed by physical and chemical methods, a very thin layer of the oxide remains firmly bound to the crystal lattice of the steel, or develops in a matter of seconds after termination of the cleaning operation. In the presence of moisture, the oxide layer forms hydroxyl groups. In the process of the present invention, the hydroxyl groups interact directly with the epoxide, hydroxyl and aziridinyl group or groups of the monomer. Monomers containing nitrogen, e.g. amines and amides, interact with the steel by their single pair of electrons on the one hand, and by their active hydrogen to the epoxide or hydroxyl groups on the other hand. The hydroxyl groups of the steel substrate react with the graft initiator to form free radicals which initiate graft polymerization, thus interweaving the monomers and prepolymers to the steel substrate and to the inorganic fillers.

The pendant groups are so designed that they contain epoxide and amine or amide functions to make them interact amongst themselves to form covalent bonds and give a three-dimensional network in which the single pair of electrons of the nitrogen can interact with the vacant orbitals of the metal iron or atom. The reaction of the epoxide and amine can be initiated prior to the graft polymerization of the free radical, thus eliminating the possibility of inhibiting of the graft reaction.

In the process of the present invention, the epoxides are made to react with the polyamides or polyamines at the appropriate temperature for a short period, e.g. a few minutes.

Then the graft monomer, initiator, and solvents are added and the solution is sprayed onto the workpiece, e.g. the ball stud of FIG. 1. The coating is then air dried and cured for an appropriate period of time, and at an appropriate temperature depending on the nature of the monomer and the ratio of the active components and catalysts.

Ball studs treated in accordance with the process of this invention have been tested in the laboratory by the standard method prescribed by the automotive industry, and have successfully passed more than 150,000 cycles in a corrosive atmosphere containing salt spray and sludge.

Preferred examples of the process and coating composition in accordance with the invention are as follows:

EXAMPLE 1

| COATING COMPOSITION | | |
|---|---|---|
| Glycidyl acrylate | 4.0 | gms. |
| Novolak epoxide | 32.0 | gms. |
| Nadeic maleic anhydride | 16.0 | gms. |
| Molybdenum sulphide | 1.0 | gms. |
| Silicon carbide | 33.0 | gms. |
| Methyl ethyl ketone | 30.0 | gms. |
| Perfluoro octyl acrylate | 1.0 | gms. |
| Silver nitrate | 0.025 | gms. |

The above ingredients were mixed in a pebble mill. Steel workpieces in the form of ball studs were cleaned with 50% hydrochloric acid and rinsed with water, followed by rinsing with methyl ethyl ketone. The composition was then sprayed on the ball studs and the latter were cured at 160° C for 1 hour followed by another hour of curing at 260° C. The ball studs were tested for adhesion and wear resistance under dynamic stress and were found to withstand more than 150 thousand cycles in a severely corrosive atmosphere.

EXAMPLE 2

| COATING COMPOSITION | | | |
|---|---|---|---|
| (A) | Polyamide (Ciba hardener 840) | 40 | gms. |
| | Dimethyl aminoethyl methacrylate | 5 | gms. |
| | Toluene | 20 | gms. |
| | Carbitol | 5 | gms. |
| (B) | Triphenol diepoxide (prepolymers) | 80 | gms. |
| | Methyl ethyl ketone | 22 | gms. |
| | Carbitol | 5 | gms. |
| | Silver nitrate soln (1%) | 1 | gm. |

Mixtures (A) and (B) were separately prepared and then mixed together with 4 gms. of Molybdenum Sulphide and 90 gms. of Silicon Carbide in a high speed blender. Ball studs were then sprayed with the slurry and cured at 160° C for 1 hour, followed by another hour curing at 260° C. They were tested for wear resistance and frictional characteristics in a corrosive atmosphere, as in Example 1, and survived more than 200,000 cycles of testing.

We claim:

1. The process, for providing a steel workpiece with a coating of organic polymeric material, which includes the steps of:

(i) applying to an exposed face of the workpiece a composition including:

(a) a polymerisable material having at least one constituent selected from the group consisting of
glycidyl methacrylate
glycidyl acrylate
dimethyl amino ethyl acrylate
hydroxy ethyl methacrylate
hydroxy propyl methacrylate (b) monomer having at least one active group, adapted to form graft polymerisation linkages with the steel and with the polymerisable material, selected from the group consisting of
hydroxyl
carbonyl
amine
amide
glycidyl
aziridinyl (c) silver nitrate as a graft initiator (ii) heating the composition until cured.

2. The process claimed in claim 1 wherein the composition further includes
inorganic filler.

3. The process claimed in claim 1 wherein the composition further includes filler material selected from the group consisting of
silicon carbide
tungsten carbide
boron nitride.

4. The process claimed in claim 1 wherein the composition further includes
wetting agent.

5. The process claimed in claim 1 wherein the composition further includes
thixotropy promoter.

* * * * *